US005119889A

United States Patent [19]

Wiggs

[11] Patent Number: 5,119,889

[45] Date of Patent: Jun. 9, 1992

[54] TUNNELING DRILL BIT

[76] Inventor: Barry F. Wiggs, 2846 Mountberg Dr., Lithonia, Ga. 30058

[21] Appl. No.: 660,293

[22] Filed: Feb. 22, 1991

[51] Int. Cl.[5] ..... E21B 7/26

[52] U.S. Cl. ..... 175/19; 175/21

[58] Field of Search ..... 175/19, 20, 21, 22, 175/23

[56] References Cited

U.S. PATENT DOCUMENTS

| | | | |
|---|---|---|---|
| 334,919 | 1/1886 | Wickizer | 175/19 |
| 673,398 | 5/1901 | Keller et al. | 175/19 |
| 3,525,405 | 8/1970 | Coyne et al. | 175/19 |

*Primary Examiner*—William P. Neuder

*Attorney, Agent, or Firm*—Hurt, Richardson, Garner, Todd & Cadenhead

[57] ABSTRACT

An apparatus for creating or reaming underground tunnels or conduits for the laying of cable or the like, comprising a bit head having a contoured outer surface adapted to bore through dirt or wood, a rigid core shaft, and a generally cylindrical hollow outer shell having a shell diameter comprising at least one circumferential shoulder having a ridge diameter greater than said shell diameter, said shoulder being located a certain distance along the length of said outer shell; wherein said bit head is releasably secured to and is coaxial with said core shaft, said core shaft is located substantially within the hollow central portion of said outer shell, and said outer shell has a length substantially equal to the length of said core shaft such that said bit head is located outside of said outer shell.

14 Claims, 3 Drawing Sheets

TUNNELING DRILL BIT

BACKGROUND OF THE INVENTION

1. Field of the Invention

This invention generally relates to the field of drill bits for tunneling through soft materials and specifically relates to a spring bore drill bit for tunneling in a generally straight line through soft earth or soft or rotten wood in order to lay underground cables such as fiber optic cables.

2. Prior Art

The inventor is unaware of any drill bits specifically developed for the task of drilling in a generally straight line through soft earth or soft or rotten wood which are maneuverable in a typical manhole environment. Currently, this task is performed by two methods, the use of larger scale underground rotary tunneling mechanisms and the use of smaller scale blunt ended rod means powered by brute force.

In the past, utility cables were installed by several methods, including merely laying the cable in a dirt trench and covering the cable with dirt and by installing a wooden conduit underground and laying the cable within the wooden conduit. Over time, as the cables become aged or obsolete, the cables need to be replaced. Current fiber optic technology allows the use of a fiber optic cable of approximately the same diameter as the old cables, such as, for example, telecommunications or electric cables, yet the fiber optic cables carry many times more information. Therefore, the fiber optic cables can be laid in approximately the same space as and in place of the old cables. However, after the old cables are removed from their beds, a new tunnel needs to be created or the dirt or wood conduit generally needs to be reamed in preparation for the insertion of the new cable.

Various methods and apparatuses for creating cable tunnels or reaming the dirt or wooden conduit are shown in the prior art. The two methods of which the inventor is most familiar include the use of various drill bits and drilling apparatuses such as U.S. Pat. No. 4,026,371 to Takata, et al., U.S. Pat. No. 4,856,600 to Baker, et al., and U.S. Pat. No. 4,674,579 to Geller, et al. However, each of these prior art patents generally are complex mechanical devices having separately rotatable bit heads, water jets, and/or steering mechanisms. Rigid rods also can be used to create tunnels or to ream conduits by brute force.

There also are various methods for reaming out soft materials, generally from pipes or conduits. For example, the well known Roto-Rooter brand equipment comprises a generally snake-like flexible driving mechanism and a generally spring-like flexible reaming head. The flexible spring-like nature of the reaming head allows the reaming head to travel around bends in pipes and to force soft material toward the back of the reaming head due to the helical nature of the spring comprising the reaming head. However, such a reaming head is inappropriate for traveling through materials harder than typical waste sludge and, due to the flexible nature, are difficult to keep traveling in a straight line without some type of wall to guide them.

When tunneling through soft dirt and when reaming prior existing conduits, it is common to encounter and possibly contact existing cables with the reaming device. Many times these cables are not encased in a hardened outer coating and are easily damaged upon contact. Many of the prior art tunneling and reaming devices, such as drills and rigid rods, have hardened and/or sharp-edged heads which easily can cause damage to existing cables.

Accordingly, it can be seen that there is a need for a mechanically simple drill bit mechanism for use in tunneling through soft earth and soft and rotten wood which is rigid enough to travel in a straight line, yet which will have a bit head which will not damage prior existing cables upon contact. The present invention is directed to accomplish this need.

SUMMARY OF THE INVENTION

In the preferred form, the present invention comprises an apparatus for tunneling through soft dirt or soft or rotten wood so as to form a new tunnel or to ream a prior existing conduit so that the new or reamed tunnel is suitable for the reception of cables. The apparatus comprises a bit head coupled to a core shaft which is then coupled to a rotary power source. The core shaft is surrounded or enveloped by an outer shell having at least one circumferential shoulder located a certain distance along the outer shell from the bit head. The outer shell preferably has a generally helical pattern along its outer surface to assist in the movement of debris along the drill bit. The use of a helical spring as the outer shell will accomplish this goal.

The apparatus uses interchangeable bit heads depending on both whether the drill bit is being used to tunnel or to help lay cable through the formed conduit, and the consistency of the medium through which the apparatus is tunneling or reaming. For example, drilling through a softer material would require a different bit head than drilling through a less soft material. Further, retrieving cable through the conduit after the conduit has been drilled or reamed would require a different bit head than the drilling or reaming process itself. Preferably, however, the bit head has a contoured front or leading portion expanding in diameter in a rearward direction until a maximum diameter is reached. The bit head may comprise a helical cutting groove about its outer surface leading from the front or leading end towards the rear or trailing end. The cutting groove should have blunt leading and trailing edges to prevent cutting of existing cables should the bit head come into contact with such existing cables. Depending axially from the rear end of the bit head is a stem or shank for coupling with the core shaft. Generally, the stem has an external helical screw thread allowing the bit head to be releasably attached to the core shaft. Preferably, the stem thread cooperates with a hollow, cylindrical, tube-like bit head coupler having an internal helical screw thread.

The core shaft is a generally rigid, elongated rod which forms the main support body for the drill bit. On either end of the core shaft is located a means for coupling the core shaft to the bit head and to the power means, respectively. Typically, an external helical screw thread is used. The core shaft couples with a power source on the end distal from the bit head. A conventional power coupler which will cooperate with a conventional power source is used for this coupling.

Surrounding or enveloping the core shaft is the outer shell. The outer shell generally is a flexible, helical spring which surrounds substantially all of the core shaft. Located a certain distance along the length of the outer shell is at least one circumferential shoulder having a diameter greater than the diameter of the outer shell. The outer shell generally gradually expands outward to the maximum diameter of the shoulder and then gradually tapers inward back to the nominal diameter of the outer shell. The shoulder serves two purposes: first, it assists in creating or reaming the conduit to a desired diameter; and second, it prevents the drill bit from buckling or snaking when rotating and being forced in a forward direction. The helical pattern on the outer surface of the outer shell helps assist the movement of dirt and debris from the front of the drill bit to the rear.

The drill bit is coupled to any conventional power source. The preferred power source is the rotating motor typically used in a Roto-Rooter brand mechanism.

The drill bit generally is of a size that it will fit in the typical manhole and can be maneuvered to a horizontal orientation without engaging the sides of the manhole. In this fashion, the drill bit can be used to tunnel in a horizontal direction without interference from the sides of the manhole. The power mechanism generally remains outside of the manhole, with a flexible, snake-like power transfer means or connection between the power source and the drill bit.

Accordingly, it is an object of the present invention to provide a drill bit which is suitable for use for tunneling through soft earth or soft or rotten wood.

It is another object of the present invention to provide a drill bit which is suitable for reaming prior existing conduits and, if such conduits are wooden conduits, removing loose or rotten wood.

Another object of the present invention is to provide a drill bit which is suitable for use in a manhole and can be easily maneuvered within a manhole.

Yet another object of the present invention is to provide a drill bit which has a rigid central core thus allowing the drill bit to travel in a generally straight line.

Still another object of the present invention is to provide a drill bit which will create or ream a conduit to a desired diameter and to remove excess dirt or debris through a helical motion, and assist in installing cable in the newly created tunnel or reamed conduit without causing damage to existing cable in the conduit.

A further object of the present invention is to provide a mechanically simple and inexpensive to manufacture drill bit for use in tunneling through soft dirt or soft or rotten wood to create a conduit suitable for the laying of cables, which drill bit can be easily used and maneuvered within the typical utility manhole.

These objects and other objects, features, and advantages of the present invention will become apparent to one skilled in the art upon reading the following specification in conjunction with the accompanying figures in which like reference numerals correspond to like parts throughout the several views.

DETAILED DESCRIPTION OF A PREFERRED EMBODIMENT

1. Apparatus

In the preferred embodiment, the present invention is a component of a complete system contemplated to be used in situ by utility workers or other workers to tunnel through soft dirt or soft or rotten wood in order to create a new conduit or to ream out an old conduit such that a tunnel is created in which a cable or cables may be laid. The complete tunneling system comprises a drill motor, a power transfer means, and a drill bit. The drill motor and power transfer means are well known in the art and may be selected from any suitable known means. The preferred drill motor and power transfer means for the drill bit of the present invention is the typical Roto-Rooter brand mechanism comprising a rotary motor and a flexible, adjustable length power transfer means such as a steel cable or ribbon.

Figure 1:
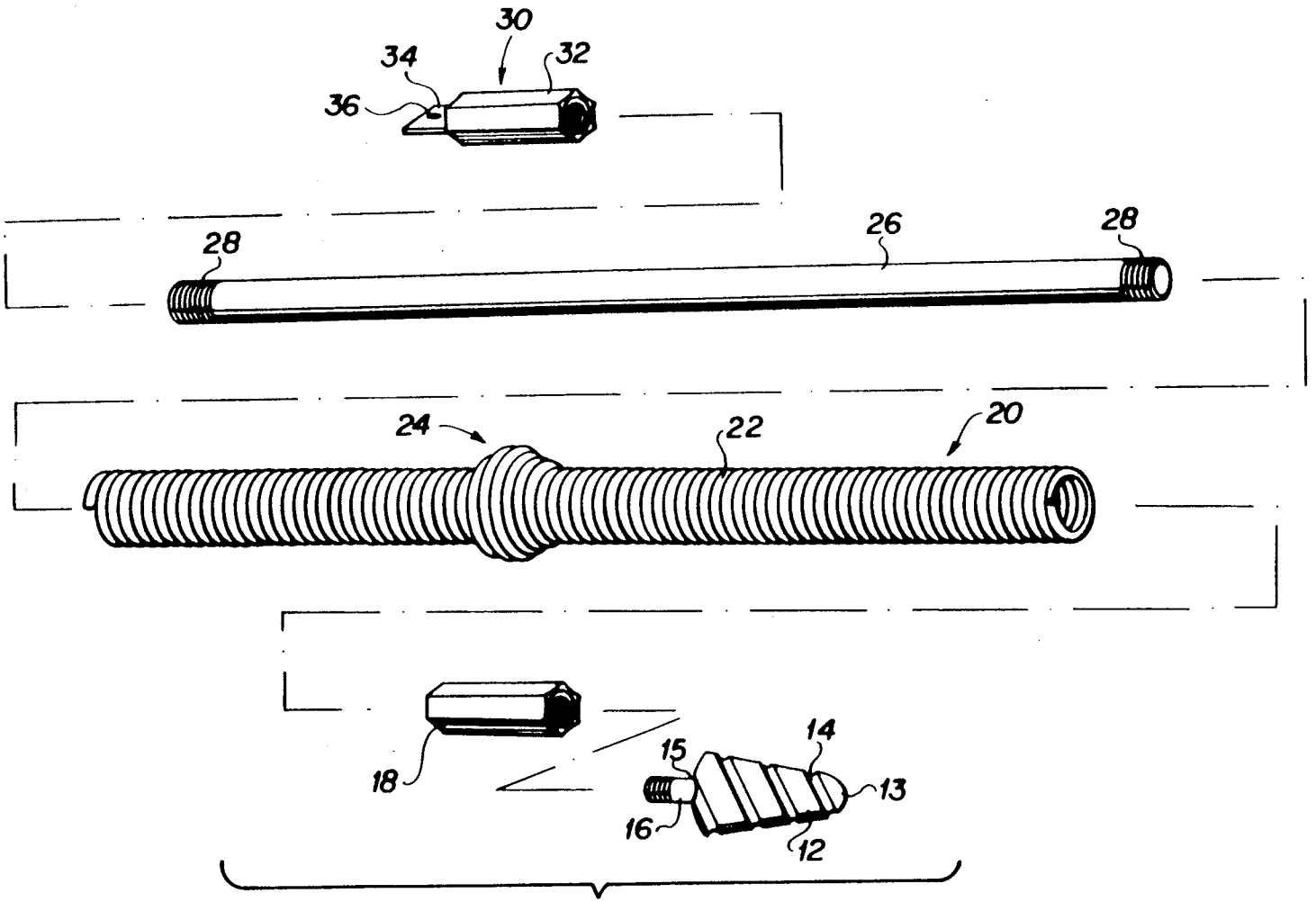
FIG. 1 is an exploded view of the drill bit of the present invention in a preferred embodiment.

Referring now to FIG. 1, the drill bit, shown generally by the numeral 10, comprises a bit head 12, an outer shell 20, and a core shaft 26. A bit head coupler 18 and a power coupler 30 are also shown for releasably coupling the bit head 12 to the core shaft 26 and for releasably coupling the core shaft 26 to the power means (not shown). However, as will be described in more detail below, bit head coupler 18 and power coupler 30 may be replaced with alternative means for attaching the bit head 12 to the core shaft 26 and for attaching the drill bit 10 to the power means.

Figure 2:
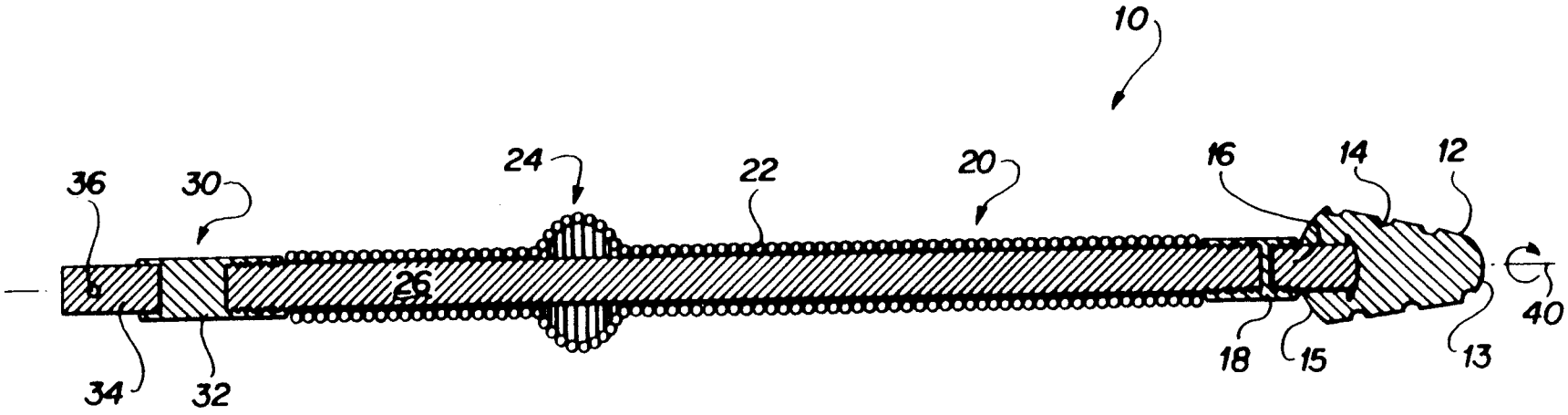
FIG. 2 is a horizontal cross section of the drill bit of the present invention in a preferred embodiment.

Referring now to FIGS. 1 and 2, the bit head 12 is a generally solid body having a generally smooth outer contour interrupted only by optional cutting grooves 14. The trailing end 15 of bit head 12 comprises a bit head stem 16 or other means for attaching the bit head 12 to the core shaft 26. Bit head 12 generally is made from an epoxy material, but may be made from any material suitable for tunneling through soft dirt or soft or rotten wood. Bit head stem 16 also may be made from any appropriate material; however, in this embodiment bit head stem 16 is a typical bolt having a conventional external screw thread on its shank.

Bit head 12 has a generally tapered shape. The leading end 13 has a relatively small diameter or profile. The bit head 12 expands to a maximum diameter at a distance distal from the leading end 13, and may taper to a smaller diameter at trailing end 15. As bit head 12 expands from leading end 13, a generally frusto-conical shape is formed.

The outer surface of bit head 12 defines a drilling surface and surface of revolution about drilling axis 40. The outer surface of bit head 12 generally has a tapered shape expanding from leading end 13 to trailing end 15, as discussed above. One or more of a series of cutting grooves 14 may be cut into the outer surface of bit head 12 in order to facilitate the drilling process. If a cutting groove or grooves 14 are cut into the outer surface of bit head 12, the cutting groove or grooves 14 should have a smooth transition from the valley of the cutting groove or grooves 14 to the outer surface of the bit head 12; that is, smooth leading and trailing edges. Smooth edges help to avoid sharp or rough edges which may damage existing cables should the drill bit 10 encounter such existing cables in operation. Cutting groove or grooves 14 generally are typically shaped cutting grooves found on drills, that is, a helical or spiral groove cut into the outer surface of a drill leading from the leading end 13 and ending at or relatively near the trailing end 15.

Figure 3C:
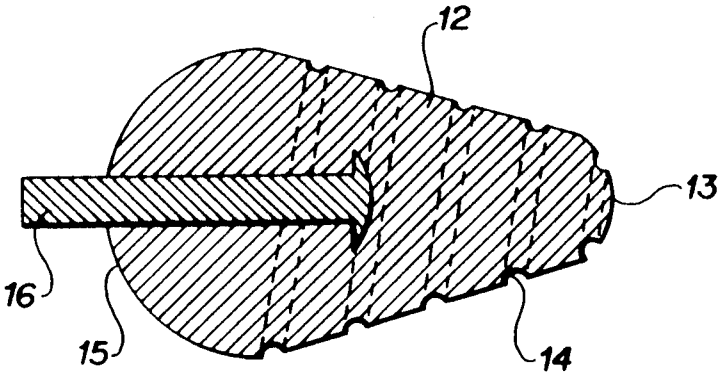
FIG. 3 are cross-sections of various alternative embodiments of the bit head of the present invention, with FIG. 3(*a*) being a conical grooveless bit head, FIG. 3(*b*) being a conical grooved bit head, and FIG. 3(*c*) being a contoured grooved bit head.
Figure 3A:
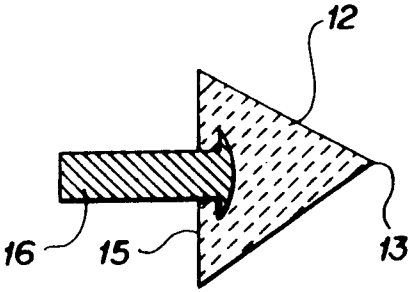
Figure 3B:
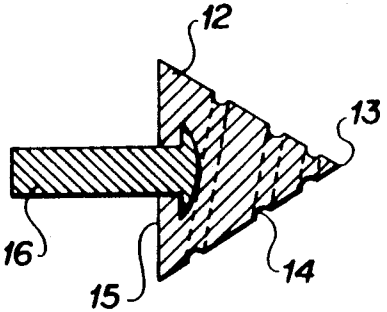

Referring now to FIG. 3, several example bit heads 12 are shown. FIG. 3*a* discloses a generally conical bit head 12 having pointed leading end 13 which expands to a maximum diameter at trailing end 15. This bit head 12 does not have cutting grooves 14 and is most appropriate for drilling through the softest dirt or wood. FIG. 3*b* discloses a bit head 12 similar to the bit head 12 shown in FIG. 3*a*; however, the bit head 12 shown in FIG. 3*b* comprises a cutting groove 14. The bit head 12 shown in FIG. 3*b* is suitable for drilling through somewhat less soft dirt or wood than the bit head 12 shown in FIG. 3*a*. The bit head 12 shown in FIG. 3*c* comprises a semi-circular or semi-ellipsoidal leading end 13 gradually expanding to a maximum diameter somewhat distal from trailing end 15, and then tapering in a generally semi-circular or semi-ellipsoidal shape along trailing end 15 to bit head stem 16, thus resulting in a generally pear- or egg-shaped bit head 12. The bit head 12 shown in FIG. 3*c* also has a cutting groove 14 and is generally suitable for tunneling through harder dirt or wood or for creating larger diameter tunnels. Various other bit heads 12, both conventional and unconventional, may be attached to the drill bit 10 depending upon the medium through which tunneling occurs. The bit heads 12 are designed to be interchangeable and may be screwed onto and off of core shaft 26 as described more fully below.

Referring back to FIGS. 1 and 2, core shaft 26 is a rigid rod, generally made from steel, which serves as the main body or backbone of the drill bit 10. Core shaft 26 also determines the relative length of the drill bit and generally is between about 12" and 60" in length. Any length shorter than about 12" would result in the wavering or snaking of the drill bit 10 as it is rotated during the tunneling operation. Any length longer than about 60" would not be easily maneuvered within the typical manhole. Core shaft 26 is a solid rod having conventional external screw threads 28 at least along the outer surfaces of the ends of core shaft 26. Alternatively, core shaft 26 may have an external screw thread along its entire length.

Outer shell 20 in its preferred embodiment is a flexible helical spring which surrounds substantially all of the core shaft 26. Therefore, the inner diameter of outer shell 20 is at least as large as the diameter of core shaft 26, with a slightly larger inner diameter desired so as to allow outer shell 20 to have some motion along and around core shaft 26. If outer shell 20 is a helical spring, it by definition has a helical pattern 20 along its outer surface. If outer shell 20 is a sleeve-like component which is not a helical spring, it is preferrable for outer shell 20 to have a helical pattern 22 formed or imprinted in some fashion about its outer surface. Helical pattern 22 assists in the forcing of dirt or debris from the leading end of the drill bit 10 along the outer shell 20 toward the trailing end of drill bit 10 when the drill bit 10 is operating, thus assisting in the formation of a suitable conduit for the future laying of cable. The use of a flexible spring as the outer shell 20 allows the outer shell 20 to flex and give should the outer shell 20 encounter obstacles such as relatively hard pieces of dirt or wood, or rocks or cable, during the tunneling operation, and be less likely to jam or break.

One or more shoulders 24 are located circumferentially around the outer shell 20. Although one shoulder 24 approximately two-thirds of the length of the outer shell 20 from the leading edge of drill bit 10 is, shown in the preferred embodiment, a plurality of shoulders 24 located at any and various Positions along the length of the outer shell 20 can be used. The diameter of shoulder 24 is somewhat larger than the diameter of outer shell 20, and shoulder 24 generally has an expanding diameter expanding from its minimum leading diameter equivalent to the diameter of the outer shell 20 and expanding to a maximum diameter and then tapering to a minimum trailing diameter also equivalent to the diameter of the outer shell 20. The shoulder 24 may be formed by any method including forming or molding the outer shell 20 to create the ridge or, if a flexible spring is used as the outer shell 20, by placing a ridge-shaped piece of material within the outer shell 20 to forceably create the shoulder 24.

Shoulder 24 serve two purposes. First, shoulder 24 assists in creating or reaming the tunnel or conduit to the desired diameter, and compacting the dirt or wood along the side of the tunnel or conduit. The expanded diameter of shoulder 24 in relation to the diameter of outer shell 20 will help create a conduit or tunnel of somewhat larger diameter than the diameter of outer shell 20. Second, shoulder 24 helps prevent the drill bit 10 from buckling or snaking when rotating and being forced in a forward direction during the tunneling or reaming process. As the diameter of outer shell 20 generally is somewhat less than the maximum diameter of the bit head 12, there is clearance between the outer shell 20 and the conduit or tunnel wall created by the bit head 12. The shoulder 24 helps prevent the outer shell 20 from moving within this clearance, thus allowing the drill bit 10 to rotate lineally and to be forced to tunnel axially. Depending on the length of the drill bit 10, the diameter of the desired conduit or tunnel, and the consistency of the medium through which the drill bit 10 is tunneling or reaming, different numbers of shoulders 24 located at different locations along outer shell 20 will be selected. Generally, the shoulders 24 will be located along the middle third of the outer shell 20 and it has been found that the use of one shoulder 24 approximately two-thirds of the length back of outer shell 20 from the bit head 12 provide satisfactory results.

Bit head coupler 18 is a hollow cylindrical tube having an internal thread. Bit head coupler 18 also may be a typical hexagonal nut or elongated hexagonal nut having an internal thread. Bit head 12 is releasably secured to bit head coupler 18 via bit head stem 16. The external screw thread located on the outer surface of the shank of bit head stem 16 cooperates with the internal screw thread of bit head coupler 18. The internal screw thread of bit head coupler also cooperates with the external screw thread 28 located along the outer surface of the leading end of core shaft 26. In this manner, bit head 12 is releasably secured to the core shaft 26 and various different bit heads 12 may be attached to the drill bit 10 for various purposes. As is obvious, bit head coupler 18 may be of many forms, including being an integral part of core shaft 26 or bit head 12. If the preferred bit head coupler 18 is used, it is preferable that the external screw thread located on the outer surface of the shank of bit head stem 16 is comparable to the external screw thread 28 on core shaft 26.

Power coupler 30 is a two-ended adapter, one end of which cooperates with the core shaft 26 and the other end of which cooperates with the power means. In the preferred embodiment, power coupler 30 has an end cap 32 which cooperates with the core shaft 26 and a flange 34 which cooperates with the preferred power means. End cap 32 is a cylindrical hollow tube having an internal screw thread which cooperates with the external screw thread 28 located on the outer surface of the trailing end of core shaft 26. In this manner, power coupler 30 may be releasably secured to the drill bit 10. Flange 34 is a generally flat rectangular component extended distally from the diameter of the trailing end of end cap 32. Located centrally through flange 34 is eyehole 36. Flange 34 and eyehole 36 shown in the preferred embodiment are specifically adapted for use on the preferred power means, namely the typical Roto-Rooter brand device. Obviously, power coupler 30 may be integrally attached to core shaft 26 or to the power means, and will be of different configurations for use with different power means.

The entire drill bit 10 can be coated, if desired. For example, the use of a Teflon brand coating may assist in tunneling. Alternatively, a powder coating of a ceramic material will help make the drill bit electrically non-conducting; an important safety feature if the drill bit 10 somehow cuts an electric line. Those skilled in the art will be able to choose an appropriate coating.

2. Operation

In use, the tunneling or reaming system is placed at or near the site, which is generally a manhole. The drill motor generally remains outside of the manhole and is connected to the drill bit 10 via the flexible, snake-like power transfer means. An appropriate bit head 12 is selected depending upon the consistency of the medium through which tunneling or reaming is to be performed. The bit head 12 is attached to the drill bit 10, the drill bit 10 is attached to the power transfer means, and the drill bit 10 is placed in the appropriate position for entering into the dirt or conduit, with the bit head 12 acting as the leading end of the drill bit 10. The power means is activated and the drill bit 10 rotates, thus tunneling or reaming into the dirt or conduit.

Figure 4:
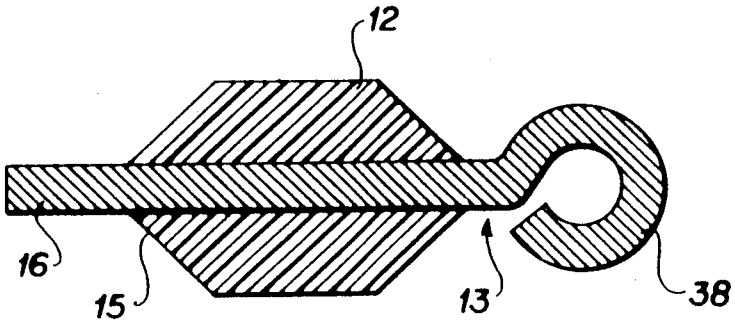
FIG. 4 is a cross section of a bit head used for pulling cable back through a tunnel created by the drill bit of the present invention.

As the drill bit 10 rotates, it travels through the dirt or conduit in a generally linear direction predetermined by the operator. Due to the nature of the bit head 12 if the bit head 12 encounters any prior existing cables, the bit head 12 will not cut or damage such cables but will force them aside, thus allowing the drill bit 10 to continue in its linear direction. Upon reaching the desired destination, generally another manhole or other access port which may be several hundred feet from the starting point, the power means is turned off. A second operator removes the bit head 12 and attaches a cable-laying bit head as shown in the FIG. 4. The cable-laying bit head shown in FIG. 4 comprises bit head 12 and the bit head stem 16. The leading end 13 typically is an elongation of the bit head stem 16 and comprises a typical hookeye 38. Being an elongation of bit head stem 16, leading end 13 and hookeye 38 have a stronger structural attachment to the drill bit 10. After the drilling bit head 12 is removed from the drill bit 10, the cable-laying bit head is releasably attached to the drill bit 10. The cable to be laid either is attached directly to the hookeye 38 or is attached via a rope or other cable to hookeye 38. The drill bit 10 is then pulled back through the newly created or reamed tunnel or conduit with the cable to be laid in tow. In this rearward direction, bit head 12 acts to keep the newly created or reamed tunnel or conduit open such that the cable is more easily laid. As is obvious, the leading end 13 of cable-laying bit head actually trails as the drill bit 10 is pulled back towards the initial manhole.

While the invention has been described in a preferred embodiment, it will be readily apparent to one skilled in the art that many modifications, additions, and deletions may be made to the invention without departing from the spirit and scope of the invention as defined by the following claims. For example, it is possible to use other material and shapes for the various components, especially the bit head, while still falling within the paremeters and equivalents of the claims.

What is claimed is:

1. An apparatus for creating or reaming underground tunnels or conduits for the laying of cable or the like, comprising a bit head having a contoured outer surface adapted to bore through dirt or wood, a rigid core shaft, and a generally cylindrical hollow outer shell having a shell diameter comprising at least one circumferential shoulder having a shoulder diameter greater than said shell diameter, said shoulder being located a certain distance along the length of said outer shell;

said bit head is releasably secured to and is coaxial with said core shaft, said core shaft is located substantially within the hollow central portion of said outer shell, and said outer shell has a length substantially equal to the length of said core shaft such that said bit head is located outside of said outer shell.

2. The apparatus as claimed in claim 1, wherein said shoulder has an expanding diameter expanding from a leading diameter equal to the shell diameter and increasing to a maximum diameter equal to the shoulder diameter and decreasing to a trailing diameter equal to the shell diameter.

3. The apparatus as claimed in claim 1, wherein said outer shell has a helical pattern about the outer surface of said outer shell.

4. The apparatus as claimed in claim 3, wherein said shoulder has an expanding diameter expanding from a leading diameter equal to the shell diameter and increasing to a maximum diameter equal to the shoulder diameter and decreasing to a trailing diameter equal to the shell diameter.

5. The apparatus as claimed in claim 2, wherein said shoulder is located at a position approximately two-thirds of the length of said outer shell back from said bit head.

6. The apparatus as claimed in claim 4, wherein said shoulder is located at a position approximately two-thirds of the length of said outer shell back from said bit head.

7. The apparatus as claimed in claim 2, further comprising a plurality of shoulders.

8. The apparatus as claimed in claim 4, further comprising a plurality of shoulders.

9. The apparatus as claimed in claim 3, wherein said outer shell is flexible.

10. The apparatus as claimed in claim 9, wherein said outer shell is a flexible spring.

11. The apparatus as claimed in claim 1, further comprising a power means.

12. The apparatus as claimed in claim 11, wherein said power means is a rotary power means.

13. The apparatus as claimed in claim 12, wherein said rotary power means comprises a motor and a power transfer means.

14. The apparatus as claimed in claim 13, wherein said power transfer means is flexible.

* * * * *